United States Patent [19]

Jostler

[11] Patent Number: 4,598,421

[45] Date of Patent: Jul. 1, 1986

[54] BELT HAVING A SUCCESSION OF PACKAGING BLANKS

[75] Inventor: Jan Jostler, Halmstad, Sweden

[73] Assignee: Jiker System Aktiebolag, Sweden

[21] Appl. No.: 742,926

[22] Filed: Jun. 10, 1985

Related U.S. Application Data

[63] Continuation of Ser. No. 354,082, filed as PCT SE81/00187 on Jun. 25, 1981, published as WO 82/00129 on Jan 21, 1982, Pat No. 4,558,556.

[30] Foreign Application Priority Data

Jun. 30, 1980 [SE] Sweden ..... 8004829

[51] Int. Cl.[4] ..... B65D 33/14

[52] U.S. Cl. ..... 383/37

[58] Field of Search ..... 383/7, 37; 229/69

[56] References Cited

U.S. PATENT DOCUMENTS

| | | | |
|---|---|---|---|
| 3,559,874 | 2/1971 | Titchenal | 229/69 |
| 3,779,449 | 12/1973 | Membrino | 229/69 |
| 3,791,573 | 2/1974 | Titchenal et al. | 383/37 |
| 4,271,883 | 6/1981 | Krause | 383/7 |

*Primary Examiner*—Stephen P. Garbe

*Attorney, Agent, or Firm*—Roberts, Spiecens & Cohen

[57] ABSTRACT

A continuously flexible belt displaying two opposing walls (5, 6) and longitudinal upper and lower edges and incorporating a number of consecutively arranged packaging blanks (2), each with a bottom section (4) at the aforementioned lower edge and two bonding zones (7, 8) arranged transversely in relation to the longitudinal direction of the belt which form the side closure of the packaging blank. In accordance with the invention the belt incorporates two strip sections (10, 11) arranged mainly opposite each other which extend in the longitudinal direction of the belt at its upper edge and which are demarcated from the packaging blanks (2) by a tear initiation (12) arranged in each wall parallel with the upper edge, whereby each strip section (10, 11) is provided with a continuous suspension device (17, 18) for cooperating with packaging blank opening guide devices (19, 20) arranged at a filling station for filling the packaging blanks, both walls of the belt also being provided with slots which have a vertical slot portion (14) arranged between the bonding zones (7, 8) of two adjacent packaging blanks and a horizontal slot portion (16) arranged on either side of the vertical slot portion and between the packaging blanks and the suspension devices, whereby two adjacent horizontal slot portions (16) are arranged at a distance from each other.

11 Claims, 7 Drawing Figures

BELT HAVING A SUCCESSION OF PACKAGING BLANKS

This is a continuation on, application Ser. No. 354,082 filed as PCT SE81/00187 on Jun. 25, 1981, published as WO82/00129 on 1/21/82 now U.S. Pat. No. 4,558,556.

The present invention relates to a continuous flexible belt which displays two opposing walls and longitudinal upper and lower edges and which incorporates a number of consecutively arranged packaging blanks, each with a bottom section at the aforementioned lower edge and two bonding zones arranged transversely in relation to the longitudinal direction of the belt which form the side closures of the packaging blank. The invention also relates to a method of filling and opening such packaging blanks.

PRIOR ART

British patent No. 1 509 639 describes a device for filling bag-shaped packagings of fabric material which are advanced by means of two drive belts in engagement with the outer sides of the packaging belt. The packagings are opened by means of a linkage mechanism and attendant interacting guide devices. The device is complicated and does not satisfy present-day demands for low costs of packaging different kinds of articles. In any event, the device is not suitable for filling bags of plastic material which are arranged in the form of a continuous belt.

SUMMARY OF THE INVENTION

An object of the present invention is to provide a continuous belt of packaging blanks which permits the use of a simplified device for filling the packaging blanks in a simple and reliable manner, particularly packaging blanks of a plastic material.

This is achieved, according to the present invention, in that the continuous belt incorporates two principally opposing strip sections which extend in the longitudinal direction of the belt at its upper edge and which are demarcated from the packaging blanks by means of a tear initiation in each wall arranged parallel to the upper edge, whereby each strip section is provided with a continuous suspension device for cooperating with packaging blank opening guide devices arranged at a filling station for filling the packaging blanks, in addition to which the belt is provided with slots in both walls, each having a vertical slot arranged between the bonding zones of two adjacent packaging blanks and a horizontal slot formed in advance or in conjunction with the filling operation on either side of the vertical slot and between the packaging blanks and the suspension devices, whereby two adjacent horizontal slots are arranged at a distance from each other. The simplified device according to the invention is characterized in that the guide devices consist of two adjacent guide bars arranged in the same place for coating with the specified belt, whereby the guide bars display end sections which are situated in the vicinity of each other and center sections which are situated at a distance from each other, these center sections being arranged to separate the strip sections of the belt in conjunction with the opening of the packaging blanks, whereby the desired material or object is placed in the packaging blanks.

BRIEF DESCRIPTION OF THE VIEWS OF THE DRAWING

The invention is described in greater detail in the following with reference to the drawing, wherein.

DETAILED DESCRIPTION

Figure 1:
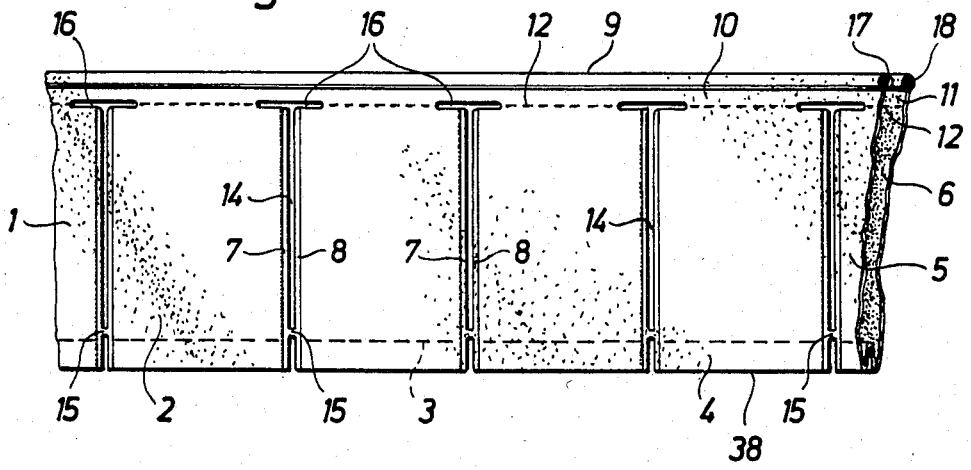
FIG. 1 is a side view of a longitudinal cross-section of a continuous belt according to the present invention.

With reference to FIG. 1, a section of a continuous belt 1, which incorporates a number of consecutively arranged packaging blanks 2, is shown. The belt has been formed by folding a broader material belt along its center line 3 to form a bottom section 4 of the packaging blanks, the bottom section being folded inward as shown in FIG. 1 during formation of the lower edge 38 of the belt. The opposing walls 5, 6 obtained through folding are joined to each other at regular intervals to form bonding zones 7, 8 which extend at right angles to the bottom section 4 of the packaging blanks. The bonding zones, which can be formed by welding gluing, or by any other suitable means, demarcate each packaging blank laterally and extend from the bottom section 4 to an upper point which is situated at a predetermined distance from the upper edge 9 of the belt. The continuous belt also incorporates two longitudinal strip sections 10, 11 which comprise the upper areas of the walls formed through folding and which are demarcated from the packaging blanks by a longitudinal perforation 12 in each wall or other tear initiation which extends principally through the upper points in the bonding zones. The perforation 12 consequently demarcates the packaging blanks at the top and defines the position of their openings 13.

Arranged in or between the bonding zones 7, 8 are vertical slots 14, and each slot 14 may be interrupted by one or more bridges 15 which hold the packaging blanks in a line after each other. Further, horizontal slots 16 are arranged in the area for the boundary between the packaging blanks and the upper strip sections 10, 11, i.e. according to the version disclosed in line with the horizontal perforation 12, whereby these horizontal slots 16 are located adjacent to the vertical slots 14 and joined to them in the form of a T. As will be evident from FIG. 1, two adjacent horizontal slots 16 are arranged at a distance from each other. The slots are arranged in both walls 5, 6 as also is the perforation 12.

The two strip sections are both provided with suspension devices which in the version disclosed consist of sections of the walls 5, 6 folded and welded to form longitudinal tunnels 17, 18 of predetermined size.

Figure 2:
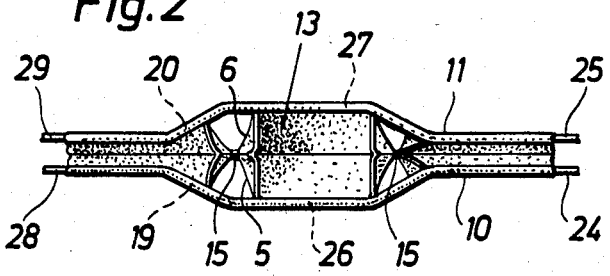
FIG. 2 shows the belt in FIG. 1 from above as it is advanced in a filling station.
Figure 3:
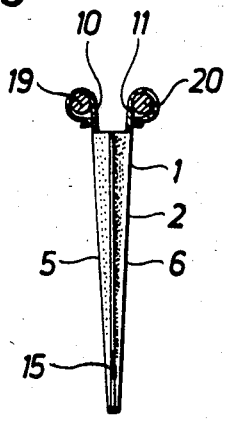
FIG. 3 is a cross-section through the belt along line III—III in FIG. 4.
Figure 4:
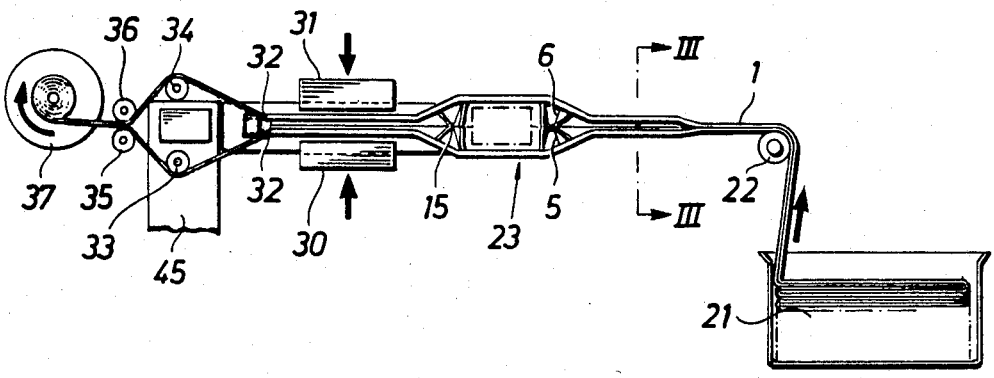
FIG. 4 shows schematically from above a device for handling a belt as in FIG. 1 from magazine to finished packagings.

The aforementioned suspension devices, which are continuous, are arranged to cooperate with special guide devices in the form of two guide bars or guide arms 19, 20 arranged in the same horizontal plane over which the suspension devices easily slide as the belt is advanced. An arrangement incorporating such guide devices is shown schematically in FIGS. 2 and 4. A continuous belt 1 is advanced from a magazine 21 in the version shown in FIG. 4 over a roller 22 to a filling station 23 which incorporates the aforementioned guide devices in the form of the two guide bars 19, 20 arranged in the same horizontal plane which extend through the tunnels of the strip sections. Viewed in the direction of travel, the bars display parallel end sections 24, 25 which are located upstream and situated in close proximity to each other and which open into centre sections 26, 27 which are situated at a predetermined distance from each other and which are partially parallel. Alternatively, they may be completely arc-shaped. The end sections 28, 29 located downstream are similarly parallel and situated in close proximity to each other. Situated in the area for the end sections 28, 29 are, in the version disclosed, two interacting welding jaws 30, 31 (FIG. 4) for sealing the packaging blanks after they have been filled at the filling station. The two bars 19, 20 are stationary and are supported by a stand (not shown) at their end sections 28, 29 situated downstream, whereby the transition sections between the bars and the two vertical parts of the stand are arranged with sharp edges to form cutting device 32 for cutting open the tunnels of the strip sections as the belt 1 is advanced. The arrangement also incorporates two opposing guide rollers 33, 34 which bring about such a change in the feed direction of the strips in relation to each other and to the belt that they are torn loose from the belt and from the filled packaging blanks which are collected at a receiving station. From the guide rollers 33, 34 the two strip sections are brought together over guide rollers 35, 36 and collected on a common take-up roller 37 which is arranged to be driven by a drive device (not shown) in the direction indicated by the arrow. The continuous belt is consequently advanced through the drive of the takeup roller 37, whereby the strip sections are accordingly pulled forward over the two guide bars which are arranged to guide the strip sections away from each other at the same time as the packaging blanks are opened so that each blank can be filled with the desired material or object. Opening is made possible, i.e. without damaging the packaging blanks, by the presence of the horizontal slots 16 whose length is chiefly the same as, or slightly more than, the distance between the two bars at their center sections. The bridges 15 can be severed by means of a suitable cutting device at the filling station as has taken place in the version according to FIG. 2 or at another suitable point situated downstream.

A supporting belt or conveyor belt, which primarily extends from the filling station, supports the packaging blanks with their contents. The finished packagings are subsequently received on a conveyor belt 45 which carries the packagings to a receiving station for packing or other handling.

The horizontal slots 16 are formed in advance in the walls at the same time as the vertical slots 14. Alternatively, at least the horizontal slots can be formed in the walls before opening and filling of the packaging blanks, e.g. in close proximity thereto or after the belt has left its magazine 21. Lateral folding of the angular sections between the horizontal and vertical slots will thus be avoided as the belt is advanced, particularly if it is advanced horizontally, unless upper uniting bridges are used.

In the version disclosed, the length of the center sections 26, 27 of the bars is such that a packaging blank 2 can be held fully open between them. If desired, these center sections 26, 27 can nevertheless be extended so that two or more packaging blanks can be opened simultaneously. The belt can be advanced intermittently or continuously, whereby in the latter case the filling device follows the movement of the belt in the filling station. The filling device may incorporate a funnel, e.g. when the material that is to be packaged is in liquid form or in free-running particle form. Alternatively, it may consist of mechanical transfer arms or a conveyor belt. Filling can of course also be carried out manually.

Figure 5:
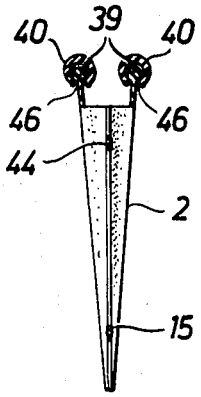
FIG. 5 is a cross-section through a belt and guide devices according to another version of the invention.

The supporting function of the tunnels of the strip sections can also be achieved with other forms of suspension devices. In FIG. 5 these are shown in the form of thicker material 39 with a circular cross-section, whereby the guide devices are modified in a corresponding manner to receive these thicker parts of the material, i.e. guide tubes 40 or guide rails with a downward-facing longitudinal slot 46, whereby the thicker material runs smoothly and without friction inside the tube or rail.

Instead of folding a material belt to form the belt of the packaging blanks it can be formed from two smaller material belts which are placed together and welded, glued or joined in some other manner along an edge to form the bottom sections of the packaging blanks.

The belt of packaging blanks consists of a flexible material which has surfaces which can be welded by heat sealing or which can be glued together or which can be joined in some other manner. A suitable plastic or a laminate which incorporates a suitable plastic layer can be used as the weldable material.

The disclosed guide devices 19, 20 are stationary and completely fixed. The same function of opening the packaging blanks can nevertheless be achieved by means of two straight and movably arranged guide bars which are situated in the same horizontal plane. The guide bars may hereby be capable of parallel lateral movement to outer positions in order to open the packaging blanks or else they may be pivotally journalled at their ends situated downstream so that their free ends can swing out to outer positions in order to open the packaging blanks.

Figure 6:
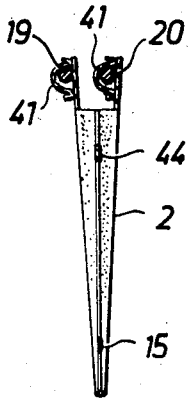
FIG. 6 is a cross-section through a belt and guide devices according to a third version of the invention.

FIG. 6 shows an alternative version of the belt as in FIG. 1, in that the tunnels of the strip sections, instead of folding the walls outward, are formed by separate strips 41 of material which are fixed to the outside of one of the belt walls and to the inside of the other wall.

Figure 7:
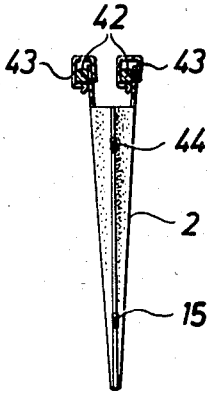
FIG. 7 is a cross-section through a belt and guide devices according to a fourth version of the invention.

FIG. 7 shows an alternative version of the belt and guide devices as in FIG. 5, in that the thicker material of the strip sections instead of being formed by the walls consists of separate round pieces 42 of material which are fixed to the outside and the inside of the belt, whereby the guide devices consist of rails 43 with a downward-facing slot. In the three latter versions (FIGS. 5, 6 and 7) there is also an upper bridge 44 arranged in the vertical slot in the vicinity of the horizontal slot. An upper bridge of this kind is principally easily breakable so that it breaks as a result of the force to which it is subjected when the walls of the belt are forced away from each other in the filling station.

What is claimed is:

1. A continuous, flexible belt of packaging blanks movable on a guiding means from an initial holding station past a filling station to a closing station, said belt comprising two opposing walls having longitudinal first and second edges and including a number of consecutively arranged packaging blanks each having a bottom section at said first edge and two bonding zones arranged transversely in relation to the longitudinal direction of the belt, which zones form side closures of the packaging blanks, said belt further comprising two strip sections arranged substantially opposite one another in the opposing walls and extending in the longitudinal direction of the belt at said second edge, each strip section including a continuous holding means for support of the strip and slidable engagement with a guiding means which serves for opening the packaging blanks at a filling station for filling the packaging blanks as said blanks travel longitudinally by travel to said holding means on the guiding means, said belt being provided with transverse slots spaced longitudinally apart in both of said walls, each transverse slot being arranged between said bonding zones of two adjacent packaging blanks and means in each wall extending on both sides of a respective transverse slot between the packaging blanks and holding means for allowing the blanks to be opened by the engagement of the holding means and the guiding means as the blanks travel past the filling station whereat the now opened blanks, slidably supported at their second edges by the holding means, are filled, the guiding means being contoured with diverging portions at the filling station such that said means in each wall which extends on both sides of a respective transverse slot enables the blanks to be opened at said filling station solely by the guiding means on which the holding means of the blanks are slidably fed, the entire first longitudinal edges of the blank being constructed to be constrained by said guiding means throughout the path of travel of the blanks from the initial holding thereof at the holding station through the closing thereof at said closing station.

2. A belt as in claim 1 wherein said holding means comprises tubular tunnels on each of said opposite strip sections.

3. A belt as in claim 1 wherein said holding means comprises a bead of material on each of said opposite strip sections, said bead of material having greater thickness than the respective wall.

4. A belt as in claim 1 wherein each said wall includes at least one bridge connecting two adjacent packaging blanks together.

5. A belt as in claim 4 wherein said at least one bridge is arranged in the vicinity of the first edge of the belt.

6. A belt as in claim 4 wherein said at least one bridge is arranged in the vicinity of said means which allows the blank to be opened.

7. A belt as in claim 4 wherein said bridge is constructed to be broken in conjunction with the opening of the associated packaging blanks.

8. A belt as in claim 1 wherein said means which allows the blank to be opened comprises a horizontal slot, the vertical and horizontal slots being joined in the shape of a T.

9. A belt as in claim 8 comprising a line of perforations in each wall aligned with the horizontal slots.

10. A belt as in claim 1 wherein said holding means at said second edge of each wall extends continuously along said wall upstream and downstream of said filling station in slidable supporting engagement with said guiding means.

11. A belt as in claim 1 wherein said holding means cooperates with said guiding means and both said means cooperatively comprise a rod member slidably received on an encircling loop provided at the upper edge of each wall.

* * * * *